US006340021B1

(12) United States Patent
Feistritzer

(10) Patent No.: US 6,340,021 B1
(45) Date of Patent: Jan. 22, 2002

(54) INTERNAL COMBUSTION ENGINE AND ITS OPERATING MODE

(76) Inventor: Bernhard Feistritzer, Kohlplatzstrasse 23/4, A-5451 Tenneck (AT)

( * ) Notice: Subject to any disclaimer, the term of this patent is extended or adjusted under 35 U.S.C. 154(b) by 0 days.

(21) Appl. No.: 09/485,674

(22) PCT Filed: Aug. 25, 1998

(86) PCT No.: PCT/AT98/00199

§ 371 Date: Feb. 23, 2000

§ 102(e) Date: Feb. 23, 2000

(87) PCT Pub. No.: WO99/10637

PCT Pub. Date: Mar. 4, 1999

(30) Foreign Application Priority Data

Aug. 25, 1997 (AT) ..... 1416/97

(51) Int. Cl.[7] ..... F02B 75/02; F02G 3/00
(52) U.S. Cl. ..... 123/543
(58) Field of Search ..... 123/543; 60/526, 60/517

(56) References Cited

U.S. PATENT DOCUMENTS

| | | | | |
|---|---|---|---|---|
| 4,280,468 A | * | 7/1981 | Millman | 123/543 |
| 4,341,070 A | | 7/1982 | Clarke | |
| 4,790,284 A | * | 12/1988 | Ferrenberg et al. | 123/543 |
| 4,928,658 A | * | 5/1990 | Ferrenberg et al. | 123/543 |
| 5,465,702 A | * | 11/1995 | Ferrenberg | 123/543 |
| 5,632,255 A | * | 5/1997 | Ferrenberg | 123/543 |
| 6,116,222 A | * | 9/2000 | Warren | 123/543 |

FOREIGN PATENT DOCUMENTS

| | | |
|---|---|---|
| EP | 0037218 | 10/1981 |

* cited by examiner

*Primary Examiner*—Marguerite McMahon
(74) *Attorney, Agent, or Firm*—Greenblum & Bernstein, P.L.C.

(57) ABSTRACT

Internal combustion engine and method of operating the engine, wherein the engine includes at least one cylinder and a cylinder head. At least one piston is included having a top dead center position wherein the piston is disposed near the cylinder head and a bottom dead center position wherein the piston is disposed away from the cylinder head. The piston and cylinder are movable with respect to one another. A crankshaft is provided. At least one intake valve and at least one exhaust valve are included. Each valve is controlled to respectively allow gas intake and exhaust gas discharge. A movable recuperator is disposed between the cylinder head and the piston. The recuperator allows at least one of intake gas to flow from the intake valve and through the recuperator, and exhaust gas to flow through the recuperator and to the exhaust valve. The recuperator moves only when the piston is in a region of the top dead center position and in a region of the bottom dead center position. The method includes introducing a compressed gaseous medium into the cylinder via the intake valve when the piston is in the region of the top dead center position, closing the intake valve, heating the compressed gaseous medium using the recuperator, combusting the gaseous medium so as to move the piston to the bottom dead center position, and opening the exhaust valve to discharge the combusted gaseous medium from the cylinder.

22 Claims, 3 Drawing Sheets

INTERNAL COMBUSTION ENGINE AND ITS OPERATING MODE

CROSS-REFERENCE TO RELATED APPLICATIONS

The present application is a National Stage Application of International Application No. PCT/AT98/00199, filed Aug.25, 1998. Further, the present application claims priority under 35 U.S.C. § 119 of Austrian Patent Application No. A-1416/97 filed on Aug. 25, 1997.

BACKGROUND OF THE INVENTION

1. Field of the Invention

The invention relates to the operating mode of an internal combustion engine having at least one piston and cylinder that can be moved with respect to one another and interact, in which a crankshaft can be driven preferably by a piston by way of a power transmission and in which the piston in the cylinder occupies in succession a bottom and a top dead center position, forming a largest and a smallest inner cylinder chamber, and the cylinder chamber can be sealed periodically, for example, by controlled valves.

The invention further includes an internal combustion engine having at least one piston and cylinder that can be moved with respect to one another and interact, in which a crankshaft can be driven preferably by a piston by way of a power transmission and in which the piston in the cylinder occupies in succession a bottom and a top dead center position, forming a largest and a smallest inner cylinder chamber, and the inner cylinder chamber can be sealed periodically, for example, by controlled valves, against a gas feed- and an exhaust gas discharge device, and optionally has a mechanism for the introduction and/or ignition of an operating fluid or fuel mixture.

2. Description of Background and Revelant Information

The operating mode of known combustion engines having a piston moved in a cylinder essentially includes a loading stroke with the introduction of air or a combustible gas mixture in the inner cylinder chamber, as well as a compression thereof by the piston moved into its top dead center position, after which, in a power stroke, a combustion of operating fluid takes place under elevation of temperature and pressure, and resulting in displacement of the piston into its bottom dead center position, whereupon, in an emission stroke, the burned gases or exhaust gases are discharged from the inner cylinder chamber. The sequence of gas feed, compression, and exhaust gas discharge is controlled by movable sealing devices, in particular valves, in the region of the cylinder head, as a function of the rotation of the crankshaft. The performance of this process, which is generally called the four-cycle principle, can be brought to higher specific levels by pressing air or combustible gas mixture into the inner cylinder chamber, for example, by way of a turbo-supercharger or compressor, because the filing of the cylinder with combustible medium can thus be increased, in particular a high engine speeds.

In the two-cycle principle, access to a feed and exhaust gas channel in the cylinder wall is opened by the piston itself in the region of the bottom dead center position, so that gas can be transported through the inner cylinder chamber, and exhaust gas can be "flushed" with a charge of fresh gas. After the charge of fresh gas or gas mixture, which is effected by elevating its pressure, the piston is moved to the top dead center position with compression of the fresh gas, in which region a combustion of the operating fluid is initiated. The pressure of the fresh gas or gas mixture is elevated by a displacement effect of the piston itself and/or by a means for elevating pressure.

All known operating modes of internal combustion engines, however, have in common the disadvantages that, on the one hand, no adiabatic or isentropic expansion of the combustion gas to essentially the ambient pressure is allowed or can be allowed to occur and, on the other hand, an isochoric dissipation of the inherent heat in the combustion gas takes place as it is discharged from the inner cylinder chamber and thus the utilization of the energy of the operating fluid or combustion gas is low.

SUMMARY OF THE INVENTION

According to the invention, there is provided an internal combustion engine comprising at least one cylinder. A cylinder head is provided. At least one piston is included having a top dead center position wherein the piston is disposed near the cylinder head and a bottom dead center position wherein the piston is disposed away from the cylinder head. The piston and cylinder are movable with respect to one another. A crankshaft is included. At least one intake valve and at least one exhaust valve are provided. Each valve is controlled to respectively allow gas intake and exhaust gas discharge. A movable recuperator is disposed between the cylinder head and the piston. The recuperator allows at least one of intake gas to flow from the intake valve and through the recuperator and exhaust gas to flow through the recuperator and to the exhaust valve. The recuperator moves only when the piston is in a region of the top dead center position and in a region of the bottom dead center position.

The recuperator may be movable away from the piston when the piston is in the region of the top dead center position and may be movable towards the piston when the piston is in the region of the bottom dead center position. The recuperator may be movable between at least a first position in which a space is defined between the cylinder head and at least a second position in which the space is reduced, and a combustion chamber may be defined between the piston and at least the recuperator. The recuperator may comprise a cross section which is essentially the same as a cross section of the cylinder. The recuperator may be disposed between the valves and the piston, and the recuperator may comprise a mechanism for moving the recuperator. The recuperator may comprise at least one of a metal, a ceramic, and a catalytically effective coating. The engine may further comprise a pressure elevating device adapted to feed a gaseous medium to the internal combustion engine. The pressure elevating device may be driven by one of the crankshaft and an external drive. The engine may further comprise a control device coupled to an intake side of the intake valve, a pressure accumulator coupled to the control device, and a pressure elevating device coupled to the control device, wherein the pressure elevating device is adapted to feed a gaseous medium to the internal combustion engine. At least a portion of the cylinder may be at least one of externally non-cooled and heat-insulated.

The invention also provides for a method of operating an internal combustion engine which includes at least one cylinder, a cylinder head, at least one piston having a top dead center position defined by the piston being disposed near the cylinder head and a bottom dead center position defined by the piston being disposed away from the cylinder head, the piston and cylinder being movable with respect to one another, a crankshaft, at least one intake valve and at least one exhaust valve, each valve being controlled to respectively allow gas intake and exhaust gas discharge, and a movable recuperator disposed between the cylinder head and the piston, the recuperator allowing at least one of intake gas to flow from the intake valve and through the recuperator, and exhaust gas to flow through the recuperator and to the exhaust valve, the method comprising introducing a compressed gaseous medium into the cylinder via the intake valve when the piston is in the region of the top dead center position, closing the intake valve, heating the compressing the gaseous medium using the recuperator, combusting the gaseous medium so as to move the piston to the bottom dead center position, opening the exhaust valve to discharge the combusted gaseous medium from the cylinder, wherein recuperator moves only when the piston is in a region of the top dead center position and in a region of the bottom dead center position.

The method may further comprise moving the recuperator away from the piston when the piston is in the region of the top dead position, and moving the recuperator towards the piston when the piston is in the region of the bottom dead center position. The method may further comprise moving the recuperator between at least a first position in which a space is defined between the cylinder head and at least a second position in which the space is reduced, wherein a combustion chamber is defined between the piston and at least the recuperator. The recuperator may comprises a cross section which is essentially the same as a cross section of the cylinder. The method may further comprise moving the recuperator via a mechanism for moving the recuperator, wherein the recuperator is disposed between the valves and the piston. The recuperator may comprise at least one of a metal, a ceramic, and a catalytically effective coating. The method may further comprise feeding the compressed gaseous medium to the internal combustion engine via a pressure elevating device. The method may further comprise driving the pressure elevating device via one of the crankshaft and an external drive. The method may further comprise coupling a control device to an intake side of the intake valve, coupling a pressure accumulator to the control device, and coupling a pressure elevating device to the control device, wherein the pressure elevating device is adapted to feed the compressed gaseous medium to the internal combustion engine. The method may further comprise at least one of externally non-cooling and heat-insulating at least a portion of the cylinder.

According to another aspect of the invention, there is provided an internal combustion engine comprising at least one cylinder. A cylinder head is disposed at one end of the cylinder. A crankshaft is included. At least one piston is coupled to the crankshaft. The piston is movable within the cylinder between at least a top dead center position and at least a bottom dead center position. At least one intake valve and at least one exhaust valve is included. Each valve is controlled to respectively allow gas intake and gas discharge. A movable recuperator is disposed between the cylinder head and the piston. The recuperator allows each of intake gas to flow from the intake valve and through the recuperator and exhaust gas to flow through the recuperator and out through the exhaust valve, wherein the recuperator is movable away from the piston when the piston is in a region of the top dead center position and wherein the recuperator is movable towards the piston when the piston is in a region of the bottom dead center position.

The invention further provides an internal combustion engine comprising at least one cylinder. A cylinder head is included. At least one piston has a top dead center position wherein the piston is disposed near the cylinder head and a bottom dead center position wherein the piston is disposed away from the cylinder head. The piston and cylinder are movable with respect to one another. A crankshaft is included. At least one intake valve and at least one exhaust valve is included. Each valve is controlled to respectively allow gas intake and exhaust gas discharge. A movable recuperator is disposed between the cylinder head and the piston. The recuperator allows at least one of intake gas to flow from the intake valve and through the recuperator and exhaust gas to flow through the recuperator and to the exhaust valve. A control device is coupled to an intake side of the intake valve. A pressure accumulator is coupled to the control device. A pressure elevating device is coupled to the control device. An external drive is provided for driving the pressure elevating device. The pressure elevating device is adapted to feed a gaseous medium to the internal combustion engine.

The invention is intended to set up an operating mode of an internal combustion engine by which the energy utilization of the operating fluid during the combustion is to be considerably increased. The invention provides for an internal combustion engine with which a considerably improved degree of efficiency is achieved.

The invention thus provides for a generic operating mode in that in a loading process in the inner cylinder chamber formed in the region of the top dead center position of the piston, a compressed gaseous medium is introduced with the opening of at least one intake sealing mechanism, the inner cylinder chamber is closed, and the compressed gaseous medium is heated by recuperation, whereupon a power stroke combustion is allowed to occur under elevated temperature and pressure in the gaseous medium confined in the cylinder chamber and brought to elevated temperature. The piston is pressed to its bottom dead center position under reduction of the temperature and pressure of the burned medium, after which in an emission stroke at least one exhaust sealing mechanism is opened. The combustion- or exhaust gas is discharged from the inner cylinder chamber by way of the piston moved to its top dead center position, under recuperative withdrawal of thermal energy.

The advantages achieved with the invention consist in particular in that, on the one hand, it is made possible for the combustion gas to expand to approximately the ambient pressure, resulting in an improved energy utilization. On the other hand, the heat or energy remaining in the combustion gas is further reduced according to the invention by heat dissipation into a recuperator, so that the exhaust gas can be brought to a considerably lower energy level and thus the energy balance of the process is considerably improved by introducing energy stored in the recuperator into the fresh gas. The result is that the residual energy in the finally discharged exhaust gas, which is not usable for the process, is considerably reduced and that the operating mode has a considerably higher degree of efficiency as far as the energy used or introduced by means of the operating fluid or gas mixture is concerned.

Here, it is particularly advantageous if, during the power stroke, provision is made for the pressure to be reduced to essentially the ambient pressure when the bottom dead center position of the piston is reached.

When diesel, gasoline, or similar fuels are used, it can be considered favorable if, during the loading process, an oxygen-containing gaseous medium or an oxygencontaining gas, in particular combustion air, is pressed into the cylinder chamber and is heated by recuperation thereby or therein, whereupon, in the power stroke, operating fluid or fuel is introduced into the cylinder chamber and is preferably brought to combustion by self-ignition or optionally by.externally supplied ignition. The required conditions for combustion of the introduced operating fluid and utilization of its energy can be optimized by adjusting the intake pressure for the gas and the amount of the fluid.

If, as can be further provided for in a favorable manner, in the loading process, a combustible gaseous medium, in particular a gasoline or the like and/or gas/air mixture, is pressed into the cylinder chamber and heated therein, whereupon, during the power stroke, this combustion gas is brought to combustion by externally supplied ignition or self-ignition, it is possible according to the invention to use fuels, for example, for gasoline, diesel, or gas motors with considerably improved degrees of efficiency.

In the operating mode according to the invention, however, as far as the discharge is concerned, it is also particularly important with respect to an improvement in the degree of efficiency for the gaseous medium provided for the loading process to be isothermally condensed or compressed, introduced into the inner cylinder chamber, and heated isochorically therein, after which, during the power stroke, a further isochoric, optionally isochoric and/or isobaric, temperature elevation takes place owing to the combustion, with a subsequent isentropic expansion of the combustion gas effected by the movement of the piston and, when the combustion gas is discharged from the inner cylinder chamber during the exhaust stroke, the perceptible heat is at least partially removed isobarically from the exhaust gas. Only when this stroke sequence or sequence of steps is maintained can a desirably high thermal degree of efficiency be achieved during the combustion of the operating fluid or gas.

Here, it is particularly important for the gaseous medium to be heated recuperatively before the power stroke by way of the thermal energy, which is stored in a storage mechanism and essentially distributed uniformly across the cross section as the combustion gases are discharged.

Here, it is particularly advantageous for the recuperative heating of the gaseous medium to be carried out in the inner cylinder chamber.

An internal combustion engine of the initially named type is defined according to the invention in that it has a recuperator through which the fed gas and the combustion gas or exhaust gas can flow alternately.

According to the invention, the residual heat of the exhaust gas is further reduced by way of the recuperator, and this energy can be recycled to the operating process, which leads to a considerable increase in the degree of thermal efficiency of the internal combustion engine.

Here, it is particularly favorable for the recuperator to be arranged in the inner cylinder chamber such that it essentially fills the cross section of the cylinder.

A further advantage with respect to an optimum functioning of the novel internal combustion engine is achieved if the recuperator is arranged so that it can be moved in the cylinder chamber, in particular so that it can be displaced in the direction of the cylinder axis. Thus, an advantageously high percentage of unburned gasoline and the like or gas/air mixture or the combustion air can be brought to a desirably high temperature or the recuperative heat exchange can be optimized.

Here, it can be advantageous for the movable recuperator mounting and/or a recuperator part to be additionally designed as an intake and/or exhaust sealing mechanism(s).

In order to achieve both high efficiency and high durability, it can be favorable for the recuperator to be formed of metal and/or ceramic.

It is particularly preferred if the recuperator carries a catalytic coating. Thus, on the one hand, as is known per se, the percentage of carbon monoxide in the exhaust gas is reduced, but, on the other hand, the thermal energy formed during the catalysis is utilizable for heating the gaseous medium introduced into the inner cylinder chamber and the degree of thermal efficiency of the internal combustion engine is improved.

In order to control directly the loading of the internal combustion engine, and also with respect to its most functionally favorable design, it can be advantageous for a pressure elevating device to be arranged in the feed area of the gaseous medium. Here, it is particularly advantageous for an evenly distributed load operation, if the pressure elevating device can be driven by the working piston by way of a coupling to the crankshaft or to the working piston. As far as the overall degree of efficiency is concerned, however, it can also be favorable if the pressure elevating device can be driven at least partially by externally supplied energy. It is also possible, for example, in a vehicle, to obtain the externally supplied energy from the braking process.

It is particularly advantageous if a pressure accumulator for the gaseous medium, which can be utilized preferably by way of a control device, is arranged in the region of the pressure elevating device or between it and the intake sealing mechanism in the gas feed device, and if this pressure accumulator can be charged by the pressure elevating device by way of an external drive via mechanical coupling mechanism to the pressure elevating device, optionally independently of the operation of the internal combustion engine.

BRIEF DESCRIPTION OF THE DRAWINGS

The invention is explained in more detail below based on drawings showing merely one embodiment.

DETAILED DESCRIPTION OF THE INVENTION

Figure 1:
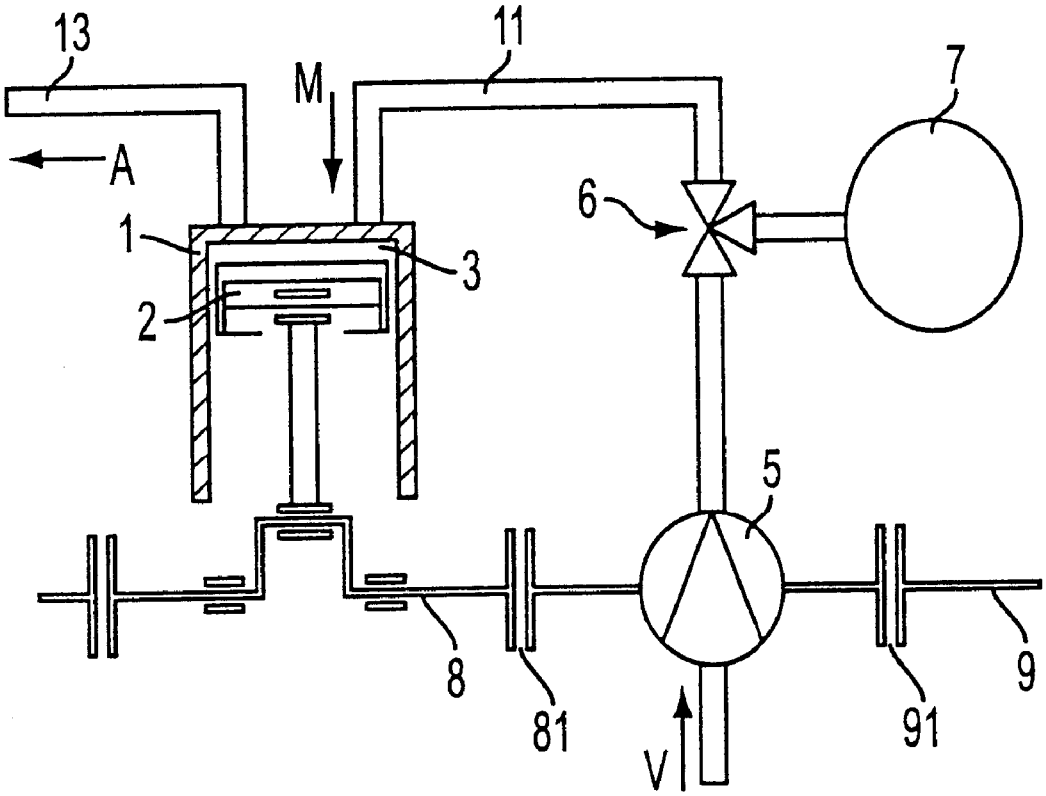
FIG. 1 shows schematically the construction of a device according to the invention.

In FIG. 1, a cylinder 1 is shown in which a piston 2 can be moved, with the piston 2 being coupled with a crankshaft 8. Combustion air V or a combustible gas mixture can be fed to a pressure elevating device 5, by which this medium is prepared for a control device 6, preferably having an attached pressure accumulator 7. By utilizing this pressure elevating device 5, which is designed so that it can be connected with the crankshaft 8 or an external drive 9 by way of a coupling 81, 91 respectively, and/or with the pressure accumulator 7, a gaseous medium M is prepared in a gas feed device 11 for the cylinder 1 via the control device 6. A recuperator 3 is arranged in the cylinder 1 in the region of the cylinder head such that it essentially fills the cross section of the cylinder 1. Combustion or exhaust gas A can be removed from the inner cylinder chamber by way of an exhaust gas discharge device 13.

Figure 2:
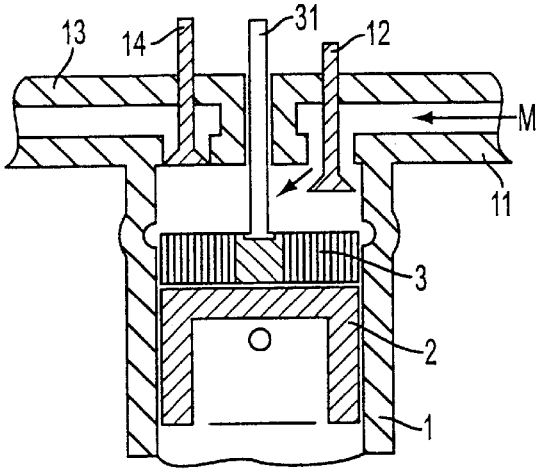
FIGS. 2 through 7 show the sequence of the process of the invention in its essential steps.

In FIG. 2, a loading process of an internal combustion engine of the invention is shown schematically, in which an isothermally condensed gaseous medium M is introduced into the inner chamber of a cylinder I through a gas feed device 11 when an intake sealing mechanism 12 is opened. A recuperator 3 with elevated temperature is then situated in the vicinity of a piston 2, which is situated in the region of its top dead center position, opening an upper inner cylinder chamber.

Figure 3:
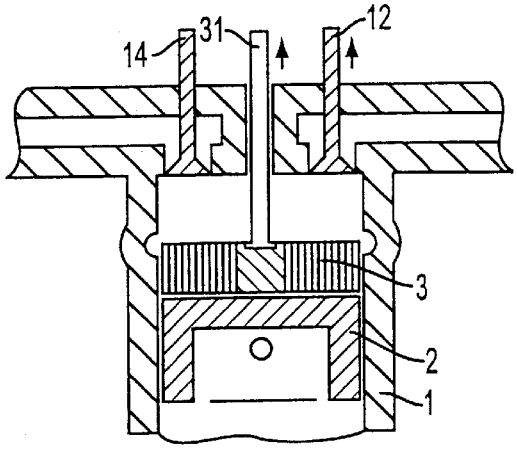

After the intake sealing mechanism 12 has been closed as shown in FIG. 3, the recuperator 3 is moved into the upper inner cylinder chamber by way of a displacing device 31, whereupon the gaseous medium flows through the recuperator 3 and is thereby heated isochorically.

Figure 4:
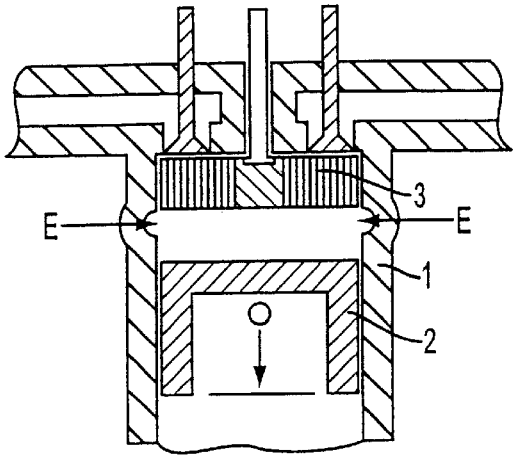

In FIG. 4, the situation during combustion of an operating fluid or fuel mixture is illustrated in which the combustion presses the piston 2 in the direction of the arrow into a bottom dead center position starting from an ignition or introduction mechanism in the region E of the cylinder 1.

Figure 5:
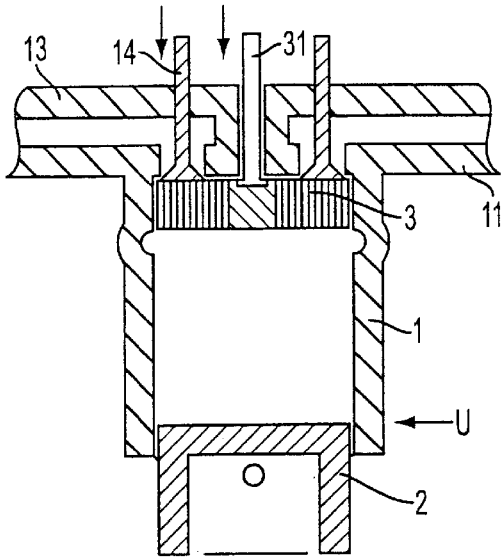

When the bottom dead center position U of the piston 2 is reached, as shown in FIG. 5, the combustion gas can essentially have assumed the ambient pressure after an isentropic expansion of the combustion gas.

Figure 6:
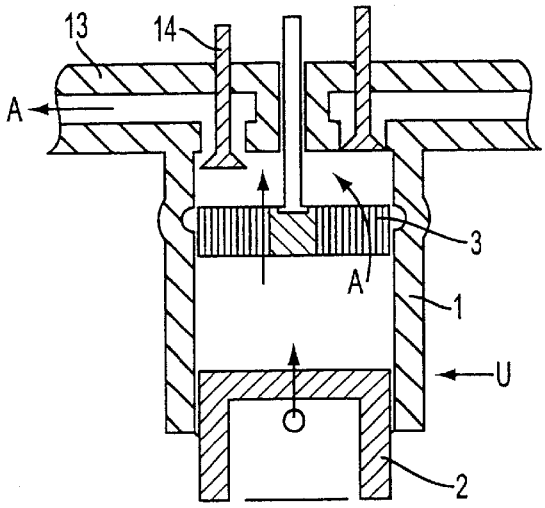
Figure 7:
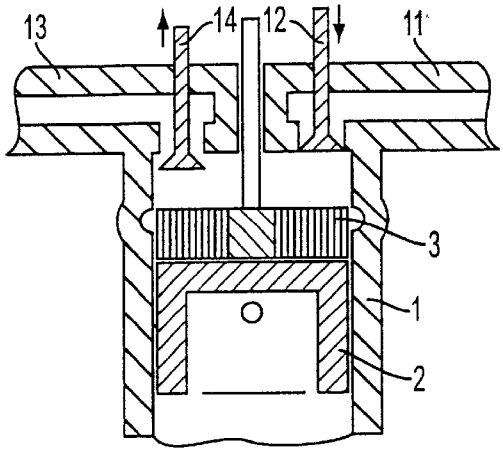

In the further sequence of the operating mode of the invention, as shown in FIG. 6, the recuperator 3 is displaced in the direction of the bottom dead center position U, and an exhaust sealing mechanism 14 is opened and a connection to an exhaust gas discharge device 13 is created. By subsequent movement of the piston 2 in the direction of the arrow towards its top dead center position, exhaust gas A is conveyed through the recuperator 3, with the recuperator 3 being heated as the exhaust gas A cools. In the top dead center position of the piston 2 in the cylinder 1, as shown in FIG. 7, the exhaust sealing mechanism 14 is caused to close, after which the internal combustion engine is made ready for a further loading process.

Because the exhaust gas A is cooled by way of a recuperator 3 before being discharged into an exhaust gas device 13, thermal stressing of the cylinder head and exhaust sealing mechanism 14 is reduced. It is even possible to provide an insulation of at least parts of the cylinder 1 to improve the degree of efficiency of the internal combustion engine.

What is claimed is:

1. An internal combustion engine comprising:

at least one cylinder;

a cylinder head;

at least one piston having a top dead center position wherein the piston is disposed near the cylinder head and a bottom dead center position wherein the piston is disposed away from the cylinder head;

the piston and cylinder being movable with respect to one another;

a crankshaft;

at least one intake valve and at least one exhaust valve, each valve being controlled to respectively allow gas intake and exhaust gas discharge; and a movable recuperator disposed between the cylinder head and the piston, the recuperator allowing at least one of:

intake gas to flow from the intake valve and through the recuperator, and exhaust gas to flow through the recuperator and to the exhaust valve, wherein the recuperator moves only when the piston is in a region of the top dead center position and in a region of the bottom dead center position.

2. The engine of claim 1, wherein the recuperator is movable away from the piston when the piston is in the region of the top dead center position and wherein the recuperator is movable towards the piston when the piston is in the region of the bottom dead center position.

3. The engine of claim 1, wherein the recuperator is movable between at least a first position in which a space is defined between the cylinder head and at least a second position in which the space is reduced, and wherein a combustion chamber is defined between the piston and at least the recuperator.

4. The engine of claim 1, wherein the recuperator comprises a cross section which is essentially the same as a cross section of the cylinder.

5. The engine of claim 1, wherein the recuperator is disposed between the valves and the piston, and wherein the recuperator comprises a mechanism for moving the recuperator.

6. The engine of claim 1, wherein the recuperator comprises at least one of a metal, a ceramic, and a catalytically effective coating.

7. The engine of claim 1, further comprising a pressure elevating device adapted to feed a gaseous medium to the internal combustion engine.

8. The engine of claim 7, wherein the pressure elevating device is driven by one of the crankshaft and an external drive.

9. The engine of claim 1, further comprising:

a control device coupled to an intake side of the intake valve;

a pressure accumulator coupled to the control device; and a pressure elevating device coupled to the control device, wherein the pressure elevating device is adapted to feed a gaseous medium to the internal combustion engine.

10. The engine of claim 1, wherein at least a portion of the cylinder is at least one of externally non-cooled and heat-insulated.

11. A method of operating an internal combustion engine which includes at least one cylinder, a cylinder head, at least one piston having a top dead center position defined by the piston being disposed near the cylinder head and a bottom dead center position defined by the piston being disposed away from the cylinder head, the piston and cylinder being movable with respect to one another, a crankshaft, at least one intake valve and at least one exhaust valve, each valve being controlled to respectively allow gas intake and exhaust gas discharge, and a movable recuperator disposed between the cylinder head and the piston, the recuperator allowing at least one of intake gas to flow from the intake valve and through the recuperator, and exhaust gas to flow through the recuperator and to the exhaust valve, the method comprising:

introducing a compressed gaseous medium into the cylinder via the intake valve when the piston is in the region of the top dead center position;

closing the intake valve;

heating the compressed gaseous medium using the recuperator;

combusting the gaseous medium so as to move the piston to the bottom dead center position; and opening the exhaust valve to discharge the combusted gaseous medium from the cylinder, wherein recuperator moves only when the piston is in a region of the top dead center position and in a region of the bottom dead center position.

12. The method of claim 11, further comprising:

moving the recuperator away from the piston when the piston is in the region of the top dead position; and moving the recuperator towards the piston when the piston is in the region of the bottom dead center position.

13. The method of claim 11, further comprising:

moving the recuperator between at least a first position in which a space is defined between the cylinder head and at least a second position in which the space is reduced, wherein a combustion chamber is defined between the piston and at least the recuperator.

14. The method of claim 11, wherein the recuperator comprises a cross section which is essentially the same as a cross section of the cylinder.

15. The method of claim 11, further comprising:

moving the recuperator via a mechanism for moving the recuperator, wherein the recuperator is disposed between the valves and the piston.

16. The method of claim 11, wherein the recuperator comprises at least one of a metal, a ceramic, and a catalytically effective coating.

17. The method of claim 11, further comprising:

feeding the compressed gaseous medium to the internal combustion engine via a pressure elevating device.

18. The method of claim 17, further comprising:

driving the pressure elevating device via one of the crankshaft and an external drive.

19. The method of claim 11, further comprising:

coupling a control device to an intake side of the intake valve;

coupling a pressure accumulator to the control device; and coupling a pressure elevating device to the control device, wherein the pressure elevating device is adapted to feed the compressed gaseous medium to the internal combustion engine.

20. The method of claim 11, further comprising:

at least one of externally non-cooling and heat-insulating at least a portion of the cylinder.

21. An internal combustion engine comprising:

at least one cylinder;

a cylinder head disposed at one end of the cylinder;

a crankshaft;

at least one piston coupled to the crankshaft;

the piston being movable within the cylinder between at least a top dead center position and at least a bottom dead center position;

at least one intake valve and at least one exhaust valve, each valve being controlled to respectively allow gas intake and gas discharge; and a movable recuperator disposed between the cylinder head and the piston, the recuperator allowing each of intake gas to flow from the intake valve and through the recuperator and exhaust gas to flow through the recuperator and out through the exhaust valve, wherein the recuperator is movable away from the piston when the piston is in a region of the top dead center position and wherein the recuperator is movable towards the piston when the piston is in a region of the bottom dead center position.

22. An internal combustion engine comprising:

at least one cylinder;

a cylinder head;

at least one piston having a top dead center position wherein the piston is disposed near the cylinder head and a bottom dead center position wherein the piston is disposed away from the cylinder head;

the piston and cylinder being movable with respect to one another;

a crankshaft;

at least one intake valve and at least one exhaust valve, each valve being controlled to respectively allow gas intake and exhaust gas discharge; and a movable recuperator disposed between the cylinder head and the piston, the recuperator allowing at least one of:

intake gas to flow from the intake valve and through the recuperator, and exhaust gas to flow through the recuperator and to the exhaust valve, a control device coupled to an intake side of the intake valve;

a pressure accumulator coupled to the control device;

a pressure elevating device coupled to the control device; and an external drive for driving the pressure elevating device, wherein the pressure elevating device is adapted to feed a gaseous medium to the internal combustion engine.

* * * * *